US006698917B2

(12) United States Patent
Etchells, III et al.

(10) Patent No.: US 6,698,917 B2
(45) Date of Patent: Mar. 2, 2004

(54) PROCESS FOR BLENDING FLUIDS OF WIDELY DIFFERING VISCOSITIES

(75) Inventors: Arthur William Etchells, III, Philadelphia, PA (US); Charles Linfred Henderson, Amelia, VA (US); Felix Alfred Streiff, Humlikon (CH); Andreas Walder, Duebendorf (CH)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 10/159,333

(22) Filed: May 31, 2002

(65) Prior Publication Data

US 2003/0095473 A1 May 22, 2003

(Under 37 CFR 1.47)

Related U.S. Application Data

(60) Provisional application No. 60/295,192, filed on Jun. 1, 2001, and provisional application No. 60/317,506, filed on Sep. 6, 2001.

(51) Int. Cl.[7] ..... B01F 5/06
(52) U.S. Cl. ..... 366/336
(58) Field of Search ..... 366/336, 337, 366/338, 339, 349, 181.5

(56) References Cited

U.S. PATENT DOCUMENTS 3,779,518 A * 12/1973 Koepke et al. ..... 366/339
4,241,023 A * 12/1980 Wilke et al. ..... 366/339
4,334,884 A * 6/1982 Wilke et al. ..... 366/176.1
4,753,535 A * 6/1988 King ..... 366/337
5,176,448 A * 1/1993 King et al. ..... 366/339
5,865,537 A 2/1999 Streiff et al.
6,179,458 B1 * 1/2001 Albers et al. ..... 366/76.1
6,419,386 B1 * 7/2002 Fleischli et al. ..... 366/336
6,428,200 B1 * 8/2002 Fleischli et al. ..... 366/336

FOREIGN PATENT DOCUMENTS

| | | |
|---|---|---|
| EP | 0472491 A1 | 2/1992 |
| GB | 2086249 A | 5/1982 |
| WO | WO 00/21650 A1 | 4/2000 |

* cited by examiner

*Primary Examiner*—Tony G. Soohoo

(57) ABSTRACT

A process is provided for blending two fluids having widely differing viscosities, such that the ratio of the two viscosities is at least 10,000:1. The low viscosity fluid is injected into the high viscosity fluid as it flows through a conduit, such that the low viscosity fluid is at least 30% by weight of the total weight of the low viscosity fluid and the high viscosity fluid. The two fluids are then forwarded to a second conduit containing a first set of static mixing elements providing a fluid shear rate in excess of 0.57 $sec^{-1}$. The two fluids are then further forwarded to a third conduit containing a second set of static mixing elements of a larger diameter than the first set, providing a fluid shear rate in excess of 0.20 $sec^{-1}$. Within the third conduit the two fluids form a homogeneous blend.

10 Claims, 3 Drawing Sheets

PROCESS FOR BLENDING FLUIDS OF WIDELY DIFFERING VISCOSITIES

FIELD OF THE INVENTION

The present invention relates to a process useful for blending two miscible fluids of widely differing viscosities at a high concentration of the low viscosity component to form a homogeneous blend of the two fluids.

BACKGROUND OF THE INVENTION

It is known that blending low viscosity additives, such as plasticizers and solvents, with a high viscosity fluid, such as a polymer melt, is a difficult problem. The low viscosity additive, if added in significant quantities, often channels through the higher viscosity fluid, resulting in incomplete blending. To mitigate this problem, frequently a mechanical mixing device employing one or more rotating shaft(s) is used in the early stages of the process to mix the low viscosity fluid into the high viscosity fluid rapidly. This mechanical mixing step has the drawbacks of increasing the process temperature due to mechanical energy input and requiring leak-proof seals around the rotating shaft in the case when one of the components to be blended is flammable or an environmental hazard. These seals present a potential safety or environmental problem since they have a tendency to rupture with wear.

Static mixers, also known as motionless mixers, have also been employed in an attempt to prevent this channeling from occurring. The static mixing elements divide the fluid flow into thin streams or striations creating increased surface area between the striations. With increasing mixer length, the additive is more finely distributed and then dissolved. U.S. Pat. No. 6,179,458 (Albers et al.) discloses the use of a mixing device wherein mechanical mixing elements are driven on a rotating shaft in a process for mixing high concentrations of a low viscosity fluid into a high viscosity fluid. To accomplish uniform mixing, the low viscosity component is added at different axial locations along the process stream with rotating mixing elements after each injection point to maintain the high viscosity fluid as the continuous phase of the mixture. Upon blending by the mechanical mixing elements whereby a homogeneous solution is formed, the solution is forwarded to a series of static mixers. Prior to each of these static mixers is an additional low viscosity fluid injection point for dilution of the solution to the desired final concentration. This system for mixing generally results in long mixer lengths and high pressure drops across the mixing elements of the system.

Static mixers have been employed to blend fluids of significantly different viscosities. European Pat. No. 472 491 B (assigned to Sulzer Chemtech Ltd.) discloses a mixing device which includes static mixing elements useful for blending a low viscosity fluid or gas and a highly viscous fluid, and an admixing device useful for introducing the low viscosity fluid or gas additive into the highly viscous fluid at a single axial location. In one disclosed embodiment, the mixing device is divided into two adjoining mixing columns, a premixer and a main mixer. The admixing device includes an opening and a nozzle for introducing the low viscosity fluid or gas into the highly viscous fluid. The orifice for combined flow is composed of a converging inlet and diverging outlet with design based on the relative flow rates and allowable pressure drops. Amounts of up to 4–6% or more of the low viscosity additive are disclosed as possible to be dissolved in the highly viscous fluid with the use of the device.

U.S. Pat. No. 5,176,448 (King et al.) discloses a static mixing device useful for blending a small amount of a low viscosity fluid with a much larger amount of a high viscosity fluid, utilizing a circular injection head biscuit placed within a conduit, the biscuit having a plurality of openings therethrough. The openings have mixing elements for inducing a rotational angular velocity to the fluid stream. The low viscosity additive is pumped through a nozzle in the biscuit.

U.S. Pat. No. 4,753,535 (King) discloses a static mixing device useful for blending or premixing a small amount of a low viscosity fluid with a much larger amount of a high viscosity fluid, comprising a generally tubular device located within a conduit. The device has an entry port shaped like the frustrum of a cone on its upstream end for the addition of one fluid to the other, and a hollow shaft on its downstream end. Within the hollow shaft are static mixing elements for the blending of the two fluids. A second mixing apparatus may be placed downstream of the device.

Attempts to increase the amount of low viscosity fluid additive to above about 10% in such blends generally result in the low viscosity component channeling through the high viscosity component. When the high viscosity phase is not continuous in laminar or turbulent flow, it becomes difficult to generate shear stress high enough for mixing or blending to occur. As a result, staged injection of the low viscosity fluid and/or additional time under shear stress become necessary so that the fluid components may be uniformly blended.

An improved process is needed by which increased amounts of a low viscosity fluid may be added to and blended with a highly viscous fluid such as a polymer at commercially attractive rates and process conditions.

SUMMARY OF THE INVENTION

The present invention is a process for forming a uniform homogeneous blend of two fluid components having a large difference in viscosity, the process comprising:

a) pumping a high viscosity fluid component into a first conduit and maintaining the high viscosity fluid component at a temperature and a pressure sufficient to allow a single phase to form;

b) injecting a low viscosity fluid component into the high viscosity fluid component flowing through the first conduit wherein the ratio of the viscosities of the two fluid components is at least 10,000:1 and the low viscosity fluid component is provided in an amount of about 30–90% by weight of the total weight of the low viscosity fluid component and the high viscosity fluid component;

c) forwarding the low viscosity and high viscosity fluid components to a second conduit connected to the first conduit containing a first set of static mixing elements having a length to diameter ratio of at least 18, such that the high and low viscosity fluid components have a shear rate in excess of 0.57 $sec^{-1}$;

d) forwarding the low viscosity and high viscosity fluid components to a third conduit connected to the second conduit, the third conduit containing a second set of static mixing elements having a diameter larger than the first set of static mixing elements and having a length to diameter ratio of at least 18, such that the high and low viscosity fluid components have a shear rate in excess of 0.20 $sec^{-1}$, whereby a uniform homogeneous blend or solution is formed.

DETAILED DESCRIPTION OF THE INVENTION

Figure 1:
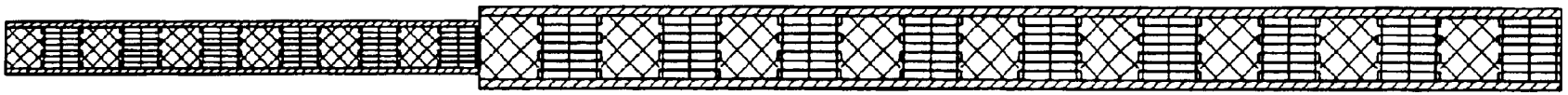
FIG. 1 (PRIOR ART)
FIG. 1 is a sectional side view of a mixing device known in the prior art.

FIG. 1 shows a mixing device as disclosed in European Pat. No. 472 491 B.

Figure 2:
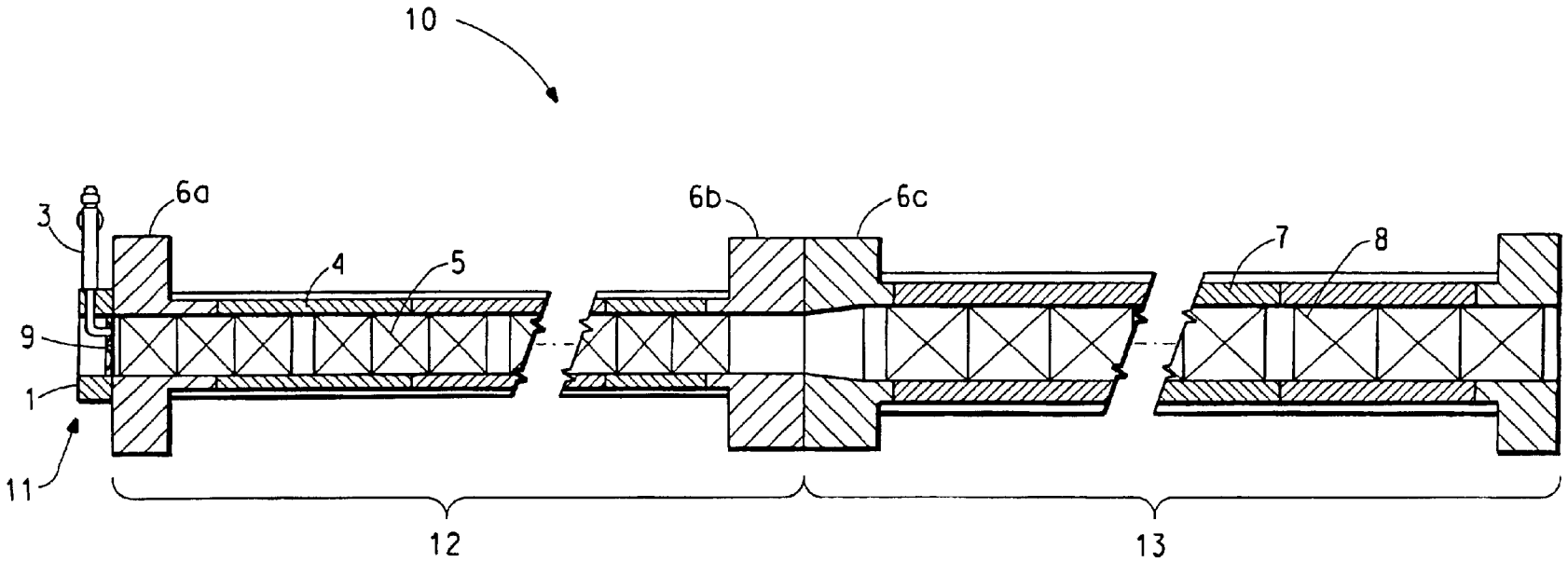
FIG. 2 is a sectional side view of a mixing device suitable for use in the process of the invention.
Figure 3:
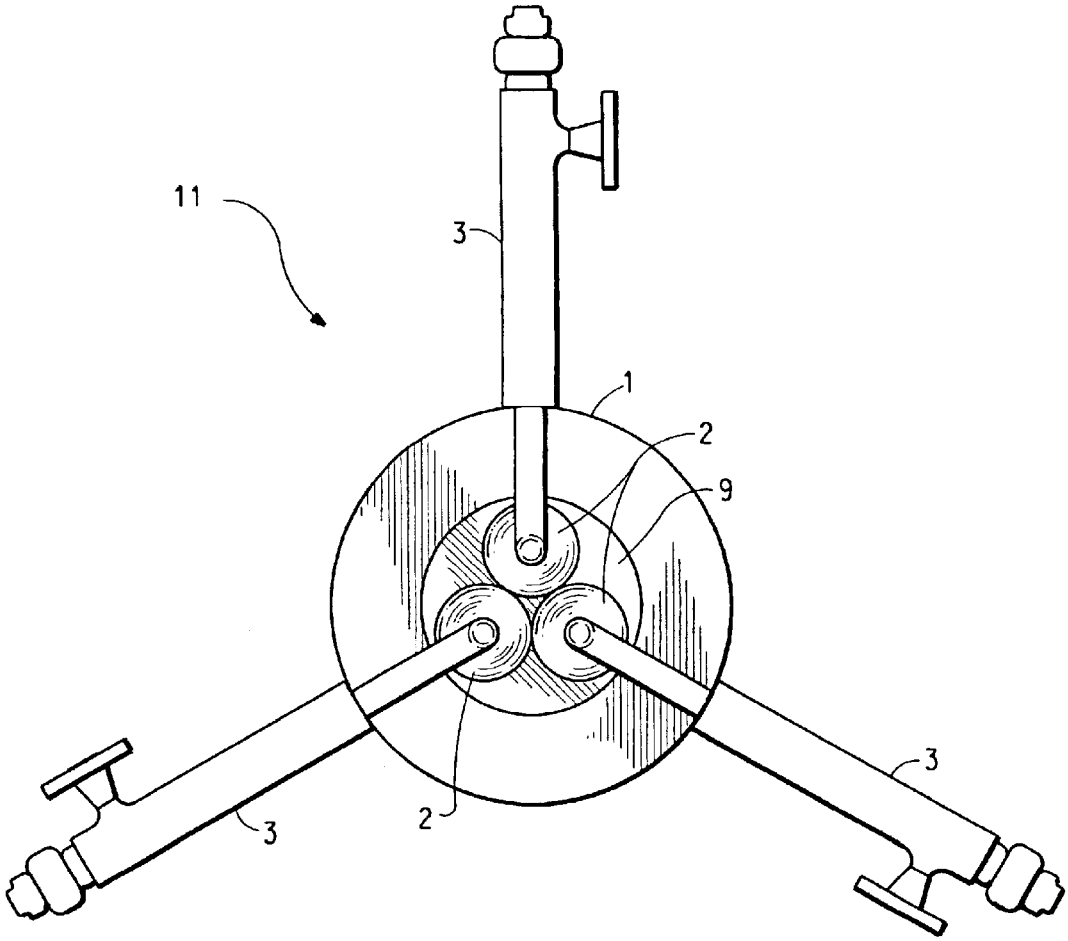
FIG. 3 is a cross-sectional view of an injection device according to the invention.

FIG. 2 shows a mixing device 10 for use in the blending process of the invention. The mixing device is similar to that described in European Pat. No. 472 491 B. The device has three sections connected in series, namely, the injection device 11, the intensive mixer 12 and the blending mixer 13, in fluid communication with each other. A cross-sectional view of the injection device 11 is shown in FIG. 3. The injection device comprises a first section of conduit 1 having at least one orifice 2 through which fluid may flow. The first section of conduit 1 in large, high capacity units has a diameter and width designed to be compatible with the injection pipe, orifice plate thickness required for support, and final orifice size for the process conditions. Each orifice 2 has a diameter based on the number of orifices, the total process throughput, the approximate amount of low viscosity fluid, and the available pressure drop. Each orifice 2 is in fluid communication with an injection nozzle 3. In a preferred embodiment, as seen in FIG. 3, the injection device 11 has a disk-shaped plate 9 across its cross-section having three orifices 2 therethrough. The three injection nozzles are located equidistant around the circumference of the first conduit 1. In FIG. 2, only one injection nozzle is shown, for clarity.

The intensive mixer 12 is a second section of conduit 4 containing static mixing elements 5 with a length to diameter ratio of at least 18, preferably at least 25. The intensive mixer has a diameter based on flow and pressure drop considerations within which shear rates in excess of 0.57 $sec^{-1}$ are obtained. The shear rate is herein defined as the velocity of the fluid flow through an empty conduit divided by the diameter of the conduit through which the fluid is flowing. A single intensive mixer conduit may be used independent of the number of orifices. The blending mixer 13 is a third section of conduit 7 containing static mixing elements 8 with a diameter larger than those of the first set of static mixing elements 5 within the intensive mixer 12, within which shear rates in excess of 0.20 $sec^{-1}$ are obtained. The length to diameter ratio of the blending mixer 13 is preferably approximately equal to or greater than that of the intensive mixer 12. The static mixing elements employed in both the intensive and the blending mixers are preferably of the SMX type, designated "SMX" by the patentees of the EP 472 491 B patent (available from Sulzer Chemtech Ltd., Winterthur, Switzerland). The device may be oriented vertically or horizontally, preferably vertically. The flow direction may be either up or down, when the device is oriented vertically.

A process utilizing the mixing device 10 described above to uniformly blend two miscible fluid components having a significant difference in viscosity will now be described. By "significant difference in viscosity" is meant that the ratio of the viscosities of the two fluid components is at least 10,000:1. Fluids having an even higher ratio of viscosities such as those with a ratio of at least 1,000,000:1, or at least 10,000,000:1, or even at least 50,000,000:1, can also be uniformly blended or solutioned with the process of the present invention.

The two fluid components are brought into contact with one another in the injection device 11. The high viscosity fluid component is pumped at a measured rate into and through the first conduit 1 of the injection device 11 where it flows through the orifice(s) 2 as a continuous phase. Preferably, the high viscosity fluid is a polymer melt which has a molecular weight greater than the critical molecular weight for the particular polymer, i.e., the minimum molecular weight at which the polymer chain molecules are entangled. The polymer melt is maintained at a temperature higher than its melting point and at a pressure sufficient to allow a single phase to form during the blending process.

The low viscosity fluid component is then metered and injected through injection nozzle(s) 3 into the orifice(s) 2 of the first conduit 1, where it comes into contact with the high viscosity fluid component. Preferably, the low viscosity fluid has a viscosity of less than 0.001 Pa-sec at 25 degrees C. The low viscosity fluid is injected in an amount greater than about 30%, preferably between about 30% and 90%, more preferably between about 40% and 80% of the total weight of the two fluids to be blended. The temperature of the low viscosity fluid component should be controlled to provide the desired exit temperature of the blend. When the high viscosity fluid is a polymer melt, this temperature should be higher than the melting point of the polymer. The exit pressure will be slightly in excess of that at the inlet. During the addition of the low viscosity fluid, the high viscosity fluid component remains a continuous phase. When the high viscosity fluid is a polymer melt, and the low viscosity fluid is a solvent for the polymer, the process of the present invention creates a homogeneous solution of the polymer and the solvent.

In one embodiment of the invention, the high viscosity fluid component is a high density polyethylene (HDPE) polymer having a weight average molecular weight of 120,000–125,000. The viscosity and density of this polymer at inlet conditions are typically about 7,000 Pa-s and 760 $kg/m^3$, respectively. In this embodiment, the low viscosity fluid component is preferably a hydrocarbon mixture having a viscosity of approximately 0.00015 Pa-s and density of 530 $kg/m^3$. The hydrocarbon mixture is injected through the injection nozzle(s) 3 in an amount between about 40% and 80% by weight of the total weight of the polymer and the hydrocarbon mixture, at a temperature between 170 and 200 degrees C. Such a fluid is useful as a spin agent in a flash spinning process for making plexifilamentary sheet material such as Tyvek® (available from E. I. du Pont de Nemours & Company, Inc., Wilmington, Del.).

Upon being introduced in the injection device, the low viscosity and high viscosity fluid components then proceed to the intensive mixer 12. The second conduit 4 is connected to the first conduit 1 by way of flange 6*a*. The second conduit 4 contains static mixing elements, preferably of the SMX type. In the high shear rate or intensive mixing stage, the low viscosity fluid begins to diffuse into the high viscosity fluid under high shear stresses generated by the static mixing elements. In the embodiment of the invention in which the high viscosity fluid component is HDPE and the low viscosity fluid component is a hydrocarbon mixture, the length to diameter ratio of the second conduit 4 is greater than 18, preferably greater than 25, and more preferably 27. The resulting pressure drop across the second conduit and the injection device is between 3,000 and 8,000 kPa depending on flow rate, temperature, concentration, and polymer type. This high pressure drop is evidence of the high shear stresses generated in the blending and distribution of the two fluids. These shear stresses force the two phases to blend, generating interfacial surface area. Diffusion of the low viscosity fluid into the polymer begins and regions of the polymer become richer in low viscosity fluid and of lower viscosity. The intensive mixer combines these regions of high and low viscosity.

At this point, the two fluid components have begun to form a blend, although striations or local concentration variability remain. The blend then proceeds to the blending mixer 13 where lower shear stresses allow the diffusion to finish and to further combine the fluids of increasingly similar viscosity into a uniform homogeneous blend with low pressure loss. The third conduit 7 is connected to the second conduit 4 by way of flanges 6*b* and 6*c*. The third conduit 7 contains larger diameter static mixers, preferably of the SMX type with a length to diameter ratio similar to that of the intensive mixer. The pressure drop across the third conduit is between about 100 and about 250 kPa, depending on flow rates, concentration, temperature and polymer types. This relatively low pressure drop is evidence of the lower shear rates in this phase of the process than in the intensive mixer 12.

Upon formation of the homogeneous blend or solution, it may be necessary to modify the concentration or the temperature of the blend, to meet the desired final conditions. To accomplish this, an amount of low viscosity fluid may be withheld from the injection into the injection device (typically 5–25% by weight of the final blend) and added subsequent to the formation of the homogeneous blend which occurs in the third conduit. This fluid addition occurs in a fourth conduit (not shown) connected in series downstream of the third conduit, the fourth conduit containing SMX mixers having a length to diameter ratio of 16 or greater. The shear rate of the fluid in the fourth conduit is approximately 5.4 $sec^{-1}$. The temperature of the subsequently added fluid can be varied to control the final blend at the desired temperature.

In addition to a liquid, the low viscosity fluid component may also be a gas such as $N_2$, $CO_2$, $H_2O$ vapor, or a supercritical fluid (that is, a gas at a temperature above which it cannot be liquefied regardless of pressure).

EXAMPLES

Example 1

An example of the blending process of the invention at commercial operating conditions is given below.

A mixing device as described above and shown in FIGS. 2 and 3 and similar to that disclosed in European Pat. No. 472 491 B was employed in a flash-spinning process for making Tyvek® plexifilamentary sheet. (Tyvek® is a registered trademark of E. I. du Pont de Nemours & Company, Inc.) The mixing device was oriented vertically with fluid flow in the upward direction. The injection device used was 250 mm in diameter and had three orifices of 25 mm diameter each. At the inlet of each of the three orifices of the injection device was an injecting nozzle composed of a one-inch diameter, schedule 160 pipe which discharged upstream of the center of the 25 mm orifice.

Molten HDPE at a continuous flow rate of 3000 kg/hr, a temperature of 220 degrees C. and a pressure of 19,720 kpa(g) was introduced into the injection device. Also introduced into the injection device was a spin agent, added via the one-inch diameter piping. The spin agent was added at a continuous total flow rate of 10,580 kg/hr, a temperature of 182 degrees C. and a pressure in excess of 19,720 kPa(g). The HDPE had a melt index of 0.7 (ASTM D-1238), a weight average molecular weight of 120,000 to 125,000, a density of 760 $kg/m^3$, and an inlet viscosity of 7,000 Pa-s. The spin agent was a hydrocarbon mixture with a density of 530 $kg/m^3$ and a viscosity of 0.00015 Pa-s. The ratio of the viscosity of the HDPE to that of the spin agent was approximately 50,000,000:1.

Molten polymer was pumped into the injection device and the polymer flow was distributed by the pressure drop through the three orifices. Through each injection nozzle, metered spin agent was injected into the polymer as it flowed through the orifice. Each nozzle injected a near equal amount of spin agent. The injection device distributed the low viscosity spin agent into the polymer while still maintaining the polymer as the continuous phase. Flow through the injection device resulted in a pressure drop of 3,140 kPa.

The high and low viscosity fluids were then forwarded to the intensive mixer composed of SMX type static mixers with a diameter of 250 mm and a length to diameter ratio of 27. In the intensive mixer, high shear rates resulted in generating surface area and blending of the two species. Diffusion of the spin agent into the polymer began as the polymer becomes richer in the spin agent and of lower viscosity. Regions of high and low viscosity fluid were blended by the intensive mixer. The pressure drop across the intensive mixer was approximately 2,450 kPa. This high pressure drop is evidence of the high shear rates and the fact that the polymer-rich phase was the continuous phase.

The partially blended fluids then flowed into the blending mixer with a diameter of 350 mm and a length to diameter ratio of 24. In the blending mixer, the SMX type mixing elements allowed final diffusion of the spin agent into the polymer and final blending of fluids with similar viscosity into a homogeneous solution of the polymer and the spin agent. The low shear stress in this section was evidenced by a low pressure drop across the blending mixer of approximately 130 kPa. The relatively low pressure drop indicates that the viscosity of the blend had been lowered in the blending mixer. This is an indication that the two fluids were successfully blended.

The homogeneous solution leaving the blending mixer consisted of 22.1 weight % concentration of HDPE in a balance of the spin agent. The solution was 192 degrees C., at a pressure of 14,030 kPa(g).

To obtain the desired final process conditions of 18.5% concentration and 185 degrees C., low viscosity spin agent was added at a rate of 16.3% by weight of the final solution to the homogeneous solution and the fluids to be finally blended passed through another conduit containing SMX type static mixers with a length to diameter ratio greater than 16. The temperature of the additional spin agent was controlled automatically to maintain the desired final process temperature.

Example 2

The following example is similar to Example 1, using the same vertically oriented mixing device in a process to produce Tyvek®, with the notable difference that one of the injection nozzles was plugged, so that only two injection nozzles were used.

Molten HDPE at a continuous flow rate of 3,020 kg/hr, a temperature of 217 degrees C. and a pressure of 23,400 kpa(g) was introduced into the injection device. Also introduced into the injection device was a spin agent, added via the one-inch diameter piping. The spin agent was added at a continuous total flow rate of 10,600 kg/hr, a temperature of 182 degrees C. and a pressure in excess of 23,400 kPa(g).

The HDPE had a melt index of 0.7 (ASTM D-1238), a weight average molecular weight of 120,000 to 125,000, a density of 760 kg/m$^3$, and an inlet viscosity of 7,000 Pa-s. The spin agent was a hydrocarbon mixture with a density of 530 kg/m3 and a viscosity of 0.00015 Pa-s. The ratio of the viscosity of the HDPE to that of the spin agent was approximately 50,000,000:1.

Molten polymer was pumped into the injection device and the polymer flow was distributed by pressure drop through the three orifices. Through two of the three injection nozzles, metered spin agent was injected into the polymer as it flowed through the orifice. Each of the two open injecting nozzles injected a near equal amount of spin agent. The injection device distributed the low viscosity spin agent into the polymer while still maintaining the polymer as the continuous phase. Flow through the injection device resulted in a pressure drop of 3,210 kPa.

The high and low viscosity fluids were then forwarded to the intensive mixer composed of SMX type static mixers with a diameter of 250 mm and a length to diameter ratio of 27. In the intensive mixer, high shear rates resulted in generating surface area and blending of the two species. Diffusion of the spin agent into the polymer began as the polymer becomes richer in the spin agent and of lower viscosity. Regions of high and low viscosity fluid were blended by the intensive mixer. The pressure drop across the intensive mixer was approximately 2,450 kPa. This high pressure drop is evidence of the high shear rates and the fact that the polymer-rich phase was the continuous phase.

The partially blended fluids then flowed into the blending mixer with a diameter of 350 mm and a length to diameter ratio of 24. In the blending mixer, the SMX type mixing elements allowed final diffusion of the spin agent into the polymer and final blending of fluids with similar viscosity into a homogeneous solution of the polymer and the spin agent. The low shear stress in this section was evidenced by a low pressure drop across the blending mixer of approximately 130 kPa. This indicates that the two fluids were successfully blended.

The homogeneous solution leaving the blending mixer consisted of 22.1 weight % concentration of HDPE in a balance of the spin agent. The solution was 192 degrees C., at a pressure of 14,030 kPa(g).

To obtain the desired final process conditions of 18.5% concentration and 185 degrees C., low viscosity spin agent was added at a rate of 16.3% by weight of the final solution to the homogeneous solution and the fluids to be finally blended passed through another conduit containing SMX type static mixers with a length to diameter ratio greater than 16. The temperature of the additional spin agent was controlled automatically to maintain the desired final process temperature.

Example 3

Another example of the blending process of the invention is given below. In this example the mixing device was oriented horizontally, again employed in a process to produce Tyvek®.

The injection device used in this example had a diameter of 113 mm and an orifice of 10 mm diameter. At the inlet of the orifice was an injecting nozzle. The injecting nozzle was a 9.5 mm internal diameter pipe positioned to discharge upstream of the center of the 10 mm orifice.

Molten HDPE at a continuous flow rate of 230 kg/hr, a temperature of 220 degrees C. and a pressure of 20,700 kpa(g) was introduced into the 113 mm diameter injection device. Also introduced into the injection device through a single pipe was a spin agent at a continuous total flow rate of 966 kg/hr, a temperature of 180 degrees C. and a pressure in excess of 20,700 kPa(g). The HDPE had a melt index of 0.7 (ASTM D-1238), a weight average molecular weight of 120,000 to 125,000, a density of 760 kg/m3, and an inlet viscosity of 24,600 Pa-s. The spin agent was a hydrocarbon mixture with a density of 539 kg/m3 and a viscosity of 0.00012 Pa-s. The ratio of the viscosity of the HDPE to that of the spin agent was approximately 200,000,000:1.

Molten polymer was pumped into the injection device. Through the injection nozzle, metered spin agent was injected into the polymer as it flowed through the orifice. The injection device distributed the low viscosity spin agent into the polymer while still maintaining the polymer as the continuous phase.

The polymer and spin agent then flowed into the intensive mixer containing SMX type static mixers having a diameter of 102 mm and a length to diameter ratio of 27. In the intensive mixer, high shear rates resulted in generating surface area and partial blending of the two species. A pressure drop of approximately 6,900 kPa across the intensive mixer and the injection device was evidence of the high shear stresses.

The partially blended fluids then flowed into the blending mixer. The blending mixer was 145 mm in diameter and had a length to diameter ratio of 24. In the blending mixer, the SMX type mixing elements allowed final diffusion of the spin agent into the polymer and final blending into a homogeneous solution of the polymer and the spin agent. The uniformity of the polymer solution at this point was observed visually through a sight glass located at the exit of the blending mixer. The low shear stresses in this section were evidenced by a low pressure drop across the blending mixer.

The homogeneous solution leaving the blending mixer consisted of 19.2 weight % concentration of HDPE in a balance of the spin agent. This solution was 186 degrees C., at a pressure of 13,500 kPa(g). To obtain the desired final process conditions of 18.5% concentration and 185 degrees C., additional low viscosity spin agent was added to the homogeneous solution and the fluids to be finally blended passed through another conduit containing SMX type static mixers with a length to diameter ratio greater than 16. The temperature of the additional spin agent was controlled automatically to maintain the desired final process temperature.

In each of these examples, the final blended solution was uniform and homogeneous, as measured by the pressure drop across the static mixing elements in the blending mixer and the continuity of the downstream product obtained. The pressure drop was measured across the static mixing elements of the blending mixer and found to be constant at a constant flow rate, indicating that the solution was homogeneous and well mixed. In each case, the Tyvek® plexifilamentary sheet produced was fully equivalent to product made from a standard process using a mechanical mixing device with a rotating shaft and staged injection of the low viscosity fluid along the length of the mechanical mixing device.

We claim:

1. A process for forming a uniform homogeneous blend of two fluid components having a large difference in viscosity, the process comprising:

a) pumping a high viscosity fluid component into a first conduit and maintaining the high viscosity fluid component at a temperature higher than the melting point and a pressure sufficient to allow a single phase to form;

b) injecting a low viscosity fluid component into the high viscosity fluid component flowing through the first conduit wherein the ratio of the viscosities of the two fluid components is at least 10,000:1 and the low viscosity fluid component is provided in an amount of about 30–90% by weight of the total weight of the low viscosity fluid component and the high viscosity fluid component;

c) forwarding the low viscosity and high viscosity fluid components to a second conduit connected to the first conduit containing a first set of static mixing elements having a length to diameter ratio of at least 18, such that the high and low viscosity fluid components have a shear rate in excess of 0.57 $sec^{-1}$;

d) forwarding the low viscosity and high viscosity fluid components to a third conduit connected to the second conduit, the third conduit containing a second set of static mixing elements having a diameter larger than the first set of static mixing elements and having a length to diameter ratio of at least 18, such that the high and low viscosity fluid components have a shear rate in excess of 0.20 $sec^{-1}$, whereby a uniform homogeneous blend or solution is formed.

2. The process of claim 1 wherein the ratio of the viscosities of the two fluid components is at least 1,000,000:1.

3. The process of claim 1 wherein the ratio of the viscosities of the two fluid components is at least 10,000,000:1.

4. The process of claim 1 wherein the ratio of the viscosities of the two fluid components is at least 50,000,000:1.

5. The process of claim 1 wherein the high viscosity fluid is molten HDPE polymer, and the low viscosity fluid is a hydrocarbon mixture.

6. The process of claim 1 wherein the low viscosity fluid component has a viscosity of less than 0.001 Pa-sec at 25 degrees C., and the high viscosity fluid component is a molten polymer having a molecular weight greater than the critical molecular weight for the polymer.

7. The process of claim 1 wherein the low viscosity fluid component is present in an amount of between 40 and 80% by weight of the total weight of the low viscosity fluid component and the high viscosity fluid component.

8. The process of claim 1 further comprising:

e) adding an additional amount of low viscosity fluid component to the blend or solution downstream of the third conduit to control the final concentration and temperature of the blend or solution.

9. The process of claim 1 wherein the first and second sets of static mixing elements are of the SMX type.

10. The process of claim 1, wherein the static mixing elements of the second conduit have a length to diameter ratio of at least 25 and the static mixing elements of the third conduit have a length to diameter ratio of at least 24.

* * * * *